US008085198B2

(12) United States Patent
Ochi

(10) Patent No.: US 8,085,198 B2
(45) Date of Patent: Dec. 27, 2011

(54) SMART ANTENNA SYSTEM AND FAILURE DETECTION METHOD FOR SMART ANTENNA SYSTEM

(75) Inventor: Yukio Ochi, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 608 days.

(21) Appl. No.: 12/284,267

(22) Filed: Sep. 20, 2008

(65) Prior Publication Data

US 2009/0079632 A1 Mar. 26, 2009

(30) Foreign Application Priority Data

Sep. 25, 2007 (JP) ..... 2007-247306

(51) Int. Cl.
*H01Q 3/00* (2006.01)

(52) U.S. Cl. ..... 342/359

(58) Field of Classification Search ..... 342/358–359, 342/372–374, 383; 343/876
See application file for complete search history.

(56) References Cited

U.S. PATENT DOCUMENTS

| | | | | |
|---|---|---|---|---|
| 5,083,131 | A * | 1/1992 | Julian | 342/372 |
| 2008/0012781 | A1 * | 1/2008 | Onomatsu | 343/876 |

FOREIGN PATENT DOCUMENTS

| | | | |
|---|---|---|---|
| JP | H04-023602 | A | 1/1992 |
| JP | H05-27683 | U | 4/1993 |
| JP | H08-162829 | A | 6/1996 |
| JP | 2003-133837 | A | 5/2003 |
| JP | 2003-318844 | A | 11/2003 |
| JP | 2004-334548 | A | 11/2004 |
| JP | 2006-013622 | A | 1/2006 |
| JP | 2006-025321 | A | 1/2006 |

OTHER PUBLICATIONS

Japanese Notice of the reason for refusal, dated Jul. 1, 2009.

* cited by examiner

*Primary Examiner* — Thomas Tarcza
*Assistant Examiner* — Nga X Nguyen
(74) *Attorney, Agent, or Firm* — Yokoi & Co., U.S.A., Inc.; Toshiyuki Yokoi

(57) ABSTRACT

Disclosed herein is a smart antenna system including an antenna body with changeable directivity, and a control device that optimizes receiving conditions of the antenna body by changing the directivity of the antenna body with a control signal based on a selected channel. The antenna body has a reception confirming section that, when a control signal is output from the control device, outputs to the control device a cognitive signal indicating the receipt of the control signal; and the control device has a failure determination section to determine that the antenna body fails when a cognitive signal is not received, and a failure reporting section to notify that the antenna body fails based on a result from the failure determination section.

2 Claims, 5 Drawing Sheets

FIG. 5A

Antenna body fails.

FIG. 5B

Set-top box fails.

SMART ANTENNA SYSTEM AND FAILURE DETECTION METHOD FOR SMART ANTENNA SYSTEM

CROSS-REFERENCES TO RELATED APPLICATIONS

The present application is related to the Japan Patent Application No. 2007-247306, filed Sep. 25, 2007, the entire disclosure of which is expressly incorporated by reference herein.

BACKGROUND OF THE INVENTION

1. Field of the Invention

The present invention relates to a smart antenna system capable of switching directivity for receiving radio waves, and more specifically to a technique for detecting a failure of an antenna body.

2. Description of the Related Art

A smart antenna system is known that is capable of optimally receiving radio waves transmitted from broadcasting stations located in different directions by switching its directivity. The smart antenna system includes an antenna body having plural antenna elements with different directivities, and a control section to switch directivity of the antenna body by controlling the drive of each antenna element. The smart antenna system maintains optimum receiving conditions by changing its directivity according to a broadcasting station transmitting radio waves. The method of controlling antenna elements of the smart antenna system is specified by the EIA/CEA-909 standard (hereinafter referred to as 909 standard).

In the smart antenna system described above, when the antenna body fails, it is more difficult to identify the cause of the failure as compared with an ordinary antenna (such as a Yagi antenna). The smart antenna allows reception of broadcast signals at a certain level even if optimum receiving sensitivity cannot be obtained due to a failure of the antenna body. Accordingly, it is difficult for a user to determine whether or not the antenna body fails. Also, according to the 909 standard, signals flows only in one direction from a set-top box to the antenna body, transmissions from the antenna body to the set-top box are not allowed.

JP-A No. 2003-318844 discloses a technique of determining whether or not an antenna is present by transmitting radio waves to the antenna body, for detection of presence or absence of an antenna in an antenna system with fixed directivity.

Also, JP-A No. 2004-334548 and JP-A No. 1996-162829 disclose a technique of detecting a failure of an antenna using a cognitive signal in an antenna with fixed directivity.

Further, JP-A No. 1993-27683 discloses a technique of diagnosing a failure based on radiation pattern measurement results in an antenna with fixed directivity.

Further, JP-A No. 2006-13622 discloses a technique of determining a failure of an antenna based on a reflected power in an antenna with fixed directivity.

The prior arts described above relate to an antenna with fixed directivity and will not make it easier to determine a failure of a smart antenna system.

BRIEF SUMMARY OF THE INVENTION

The present invention is to provide a smart antenna system which maintains optimum receiving conditions by changing its directivity and which is capable of detecting a failure of the antenna body, and also a method of detecting a failure of the smart antenna system.

The present invention discloses a smart antenna system for receiving a broadcasting, comprising: an antenna body with changeable directivity, a control device that optimizes receiving conditions of said antenna body by changing the directivity of the antenna body with a control signal based on a selected channel; and said antenna body comprises a reception confirming section to output to said control device a cognitive signal indicating the receipt of a control signal when the control signal is output from said control device; said control device comprises a failure determination section to determine that said antenna body fails when said cognitive signal is not received, and a failure reporting section to notify that said antenna body fails based on a result from said failure determination section.

In the invention as configured above, the smart antenna system includes the antenna body capable of switching the directivity for received radio waves, and the control device that switches the directivity of the antenna body by outputting a control signal. In such a smart antenna system, the antenna body, when a control signal is output from the control device, outputs to the control device a cognitive signal indicating that the reception confirming section received the control signal. Also, the control device has the failure determination section and if this section did not receive the cognitive signal the failure reporting section notifies the failure of the antenna body.

This makes it possible to determine the failure of the antenna body.

BRIEF DESCRIPTION OF THE DRAWINGS

FIGS. 5A and 5B show exemplary failure display screens respectively.

DETAILED DESCRIPTION OF THE INVENTION

Preferred embodiments of the present invention are described below with reference to the accompanying drawings; the same parts are designated with the same numerals to avoid redundant explanations.

1. Configuration of the Present Invention
2. Embodiments
   2.1 Configuration of a Broadcast Signal Reception System.
   2.2 Operation and Advantages of the Broadcast Signal Reception System.
3. Modifications
4. Conclusion

1. Configuration of the Present Invention

Figure 1:
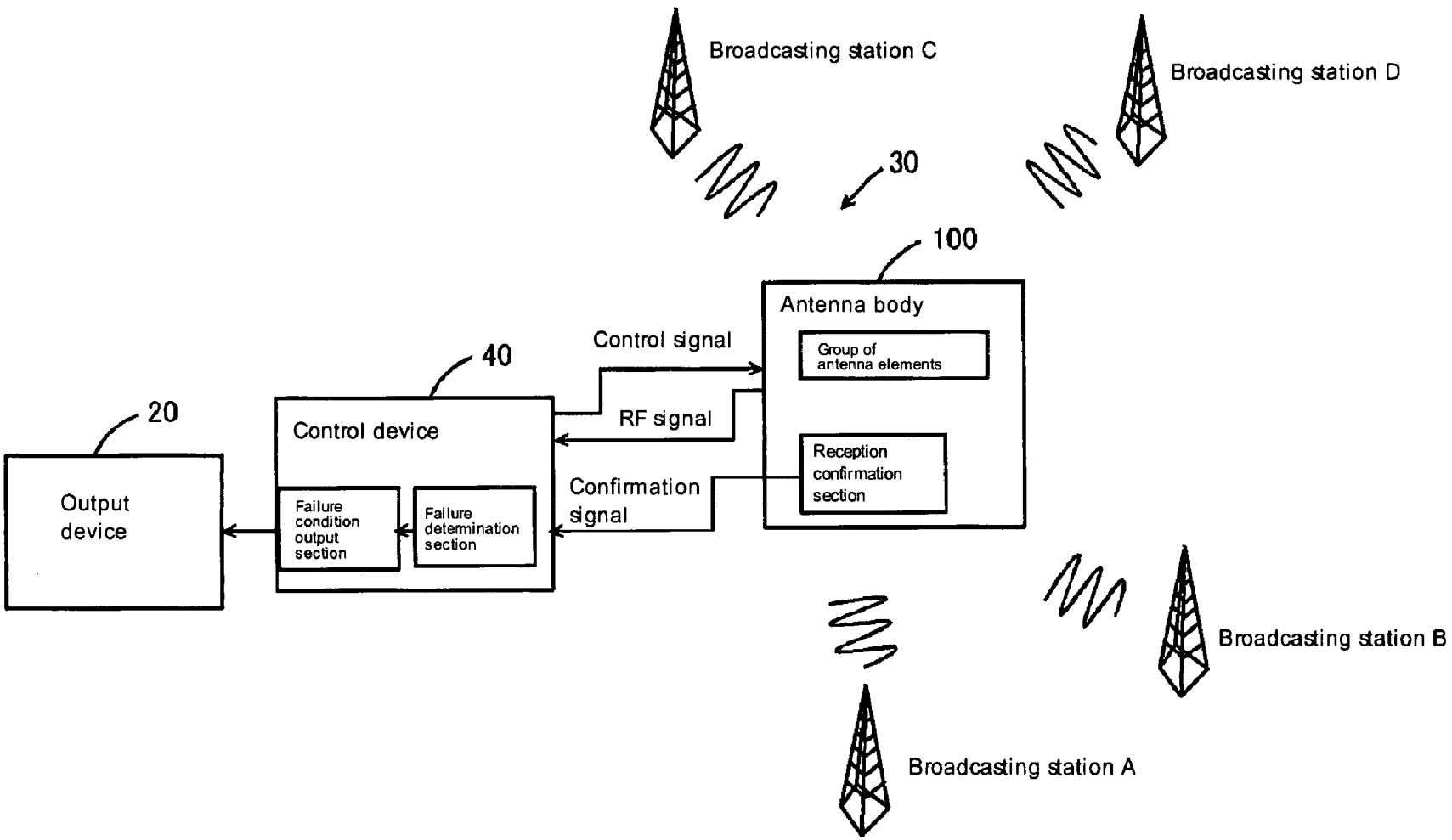
FIG. 1 is a diagram illustrating a broadcast signal reception system of the present invention.

FIG. 1 is a diagram illustrating a broadcast signal reception system of the present invention. The broadcast signal reception system 10 of the present invention is, for example, a system to optimally receive broadcast signals transmitted from broadcasting stations located in different directions by switching the directivity of the antenna body. Therefore, the broadcast signal reception system 10 is composed of a smart antenna system 30 that receives broadcast signals and converts the received broadcast signals to a form in which an output device 20 can receive; and the output device 20 that outputs video and audio signals based on the converted broadcast signals.

The smart antenna system 30 includes an antenna body 100 having a group of antenna elements with different directivities, and a control device 40 to control the antenna body 100. In the smart antenna system 30, when a user selects a particular channel, the control device 40 outputs to the antenna body 100 a control signal to change the directivity so that the antenna body can receive broadcast signals in optimal conditions. The antenna body 100 changes the direction of directivity based on the received control signal so as to receive broadcast signals optimally.

The antenna body 100 of the present invention has a reception confirming section that notifies that the control signal is received, by returning a cognitive signal. Also, the control device 40 has a failure determination section to receive the cognitive signal. If the antenna body 100 fails, the reception confirming section cannot transmit the cognitive signal to the control device 40. Therefore, the failure determination section determines that the antenna body 100 fails since the cognitive signal is not received.

2. Embodiments

2.1 Configuration of the Broadcast Signal Reception System

Figure 2:
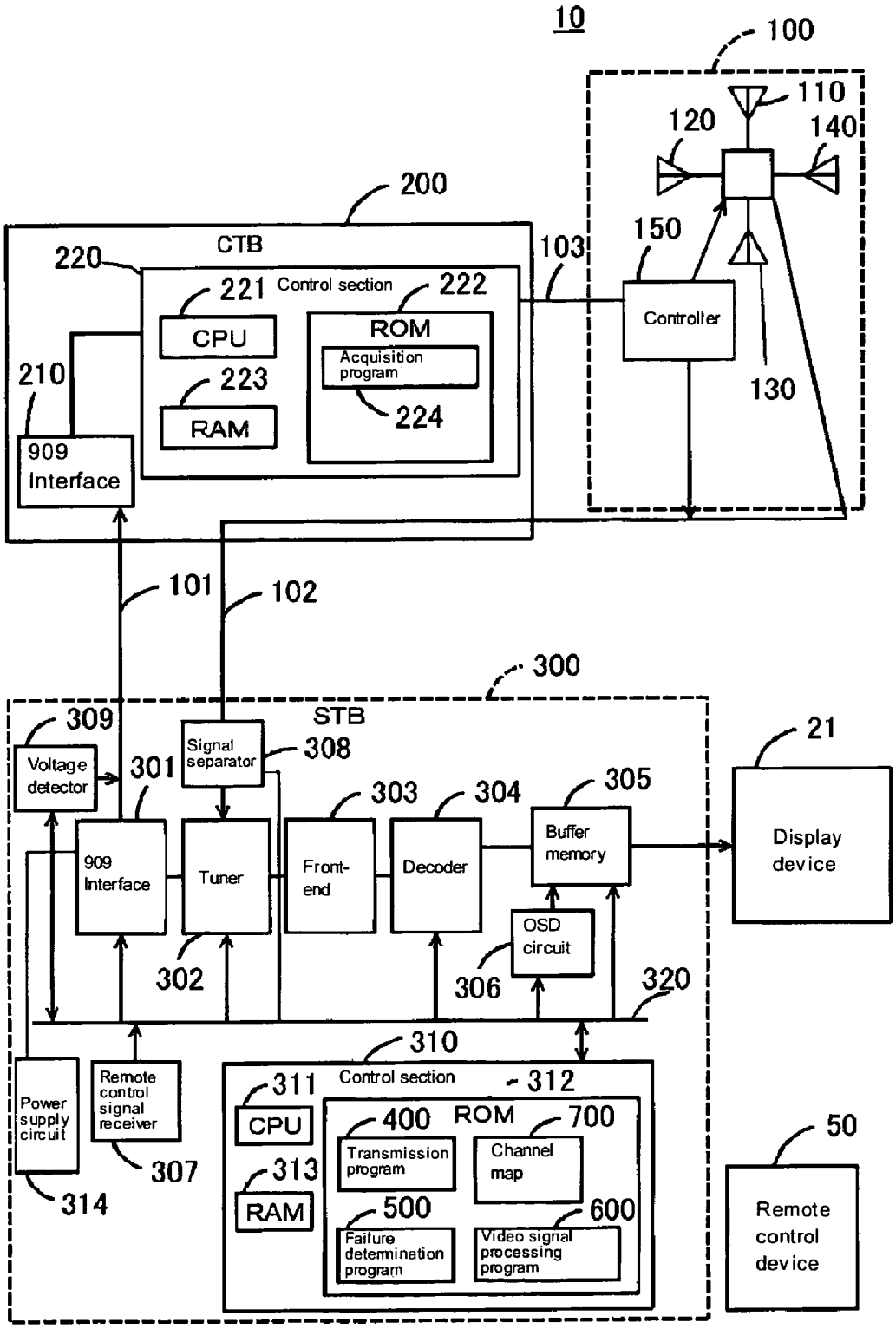
FIG. 2 is block diagram illustrating an embodiment of the broadcast signal reception system.

FIG. 2 is a block diagram illustrating an embodiment of the broadcast signal reception system. The broadcast signal reception system 10 includes the antenna body 100, a control box 200, a set-top box 300, display device 21, and a remote control device 50. The antenna body 100 serves as a receiver of television broadcast signals (hereinafter referred to as broadcast signals). The control device 40 is implemented with the control box (hereinafter referred to as CTB) 200 and the set-up box (hereinafter referred to a STB) 300. Also, the output device 20 is implemented with the display device 21 that outputs video and audio.

The CTB 200 and the STB 300 are connected through wires 101 and 102. Also, the antenna body 100 and the CTB 200 are connected through a wire 103. Here, the wire 101 is used to communicate a control signal between CTB 200 and STB 300 in a particular manner and to feed a supply voltage from a power supply circuit 314 to the CTB 200. The wire 102 is used to transmit broadcast signals received by the antenna 100 to the STB 300. Further, the wire 103 is used to transmit a signal from the CTB 200 to the antenna body 100.

In the broadcast signal reception system 10, when the STB 300 receives a channel select instruction from a user through the remote control 50 or the like, the STB 300 transmits a control signal to the CTB 200 through the wire 101. The CTB 200 transmits a second control signal to the antenna body 100 based on the received control signal. The second control signal is a signal to change the directivity so as to optimize receiving conditions at the antenna body 100. The antenna body 100 receives television broadcast signal based on the second control signal and converts the received radio waves into electric currents. The CTB 200 outputs the electric currents based on the received broadcast signals to a tuner (described below) of the STB 300 via the wire 102. By the series of operations described above, broadcast signals are output to the STB 300.

The STB 300 produces video and audio signals based on received broadcast signals, and outputs the produced video and audio signals to the display device 21. The display device 21 performs a digital/analog conversion of the received video and audio signals to output them as pictures and sounds respectively. By the series of operations described above, the broadcast signal reception system 10 outputs pictures and sounds through broadcast signals.

Also, in the broadcast signal reception system 10 of this embodiment, the antenna body 100 returns a cognitive signal to the STB 300 upon receipt of the second control signal. Further, the STB 300 has a function of switching between display and not-display of the failure display screen depending on whether or not the cognitive signal is returned. This allows a user to visually judge that the antenna body fails when the failure display screen is displayed.

The antenna body 100 includes antenna elements 110 to 140 with fixed directivity and a controller 150 to control the drive of these antenna elements 110 to 140. The antenna body 100 of this embodiment has four antenna elements 110 to 140 arranged radially, and the controller 150 can change the direction of the antenna body 100 to 16 directions of high directivity by changing the electric field intensity detected by these antenna elements 110 to 140. Here, the controller 150 serves to control the drive of the antenna body 100, and in the present invention a failure of the antenna body 100 means a defect in the antenna body 100 attributable to a failure of the controller 150.

Further, the controller 150 has a reception confirmation function that notifies presence or absence of a failure of the antenna body 100 by transmitting a cognitive signal to the STB 300 through the wire 102 when the second control signal is received from the CTB 200. Here, the wire 102 is used to transmit broadcast signals to the CTB 200, and in the present invention a cognitive signal is transmitted to the CTB 200 by multiplexing a cognitive signal and a broadcast signal.

The CTB 200 transmits the second control signal to the controller 150 of the antenna body 100 based on the directivity set for each channel by the STB 300. The CTB 200 has a 909 interface 210 and a control section 220.

The 909 interface 210 is, for example, connected to a 909 interface 301 (described below) of the STB 300 through the wire 101, and serves to perform communications according to a predetermined communication scheme (such as EIA/CEA-9-9). Therefore, the 909 interface 210 receives a control signal for controlling the antenna body 100 from the STB 300, and transmits a signal based on the control signal to the control section 220 of the CTB 200. According to the EIA/CEA-900 standard, only the transmission of a signal from STB 300 to CTB 200 is performed. Accordingly, it is impossible to return a signal from the antenna body 100 or the CTB 200 to the STB 300 using the wire 101.

The control section 220 includes a CPU (Central Processing Unit) 221, a ROM (Read Only Memory) 222, and a RAM (Random Access Memory) 223. The CPU 221 performs various control operations according to various processing programs stored in the ROM 222. The ROM 222 contains a system program executable in the CTB 200, various processing programs executable by the system program, data to be used in executing these processing programs, data resulting from the processing by the CPU 221, and the like. The programs are stored in the ROM 222 in the form of computer-readable program codes. To be specific, an acquisition program 224 is stored in the ROM 222.

The acquisition program 224 is a program, for example, to realize a function of acquiring a control signal transmitted from a 909 interface 301 (described below) of the STB 300.

Here, the control signal is, for example, information based on a channel (virtual channel) selected by a user, including, for example, information on physical channel number and antenna body directivity and information on antenna gain. Using such information, the CPU 221 controls the controller 150 of the antenna body 100 to change the direction of directivity of the antenna body 100.

The STB 300 switches the directivity of the antenna body 100 to an optimum direction based on the instruction from a user. Also, the STB 300 converts a received broadcast signal to a signal form in which the display 21 can receive. The STB 300 is composed of the 909 interface 301, the tuner 302, a front-end 303, a decoder 304, a buffer memory 305, an OSD circuit 306, a remote control receiver 307, a signal separator 308, a voltage detector 309, and the control section 310. These sections are interconnected through an external bus 320 by which communications are made.

The 909 interface 301 is connected to the 909 interface 210 of the CTB 200 through the wire 101, and communicates are made with the 909 interface 210 of the CTB 200 based on a predetermined communication scheme according to a control signal to be input from the control section 310. Also, the 909 interface 301 supplies to the CTB 200 a control signal for controlling the antenna body 100 and a supply voltage for driving the CTB 200.

The tuner 302 detects a selected channel (for example a virtual channel) from received broadcast signals. The tuner 302 is connected to the CTB 200 through the wire 102, which is also connected to the antenna body 100. The tuner 302 detects a broadcast signal corresponding to one channel (a channel selected by a user) from among the broadcast signals transmitted from the antenna body 100, and outputs it to the front-end 303.

The front-end 303 converts the broadcast signal transmitted from the tuner 302 into an IF signal according to an instruction to be input from the control section 310, and outputs it to the decoder 304.

The decoder 304 processes broadcast signals output from the front-end 303 according to a predetermined file format, such as MPEG-2 (Motion Picture Experts Group-2), in accordance with an instruction from the control section 310, and separates the broadcast signals into audio and video signals to decode them. Then, the decoded video signals are output to the buffer memory 305. The audio signals are output directly to the display device 21.

The buffer memory 305 is a memory to store temporarily the video signals decoded by the decoder 304. The video signals stored in the buffer memory 305 are output to the display device 21 sequentially.

The OSD circuit 306 overlaps the video signals stored in the buffer memory 305 with a predetermined OSD (On Screen Display) image, according to an instruction from the control section 310.

The remote control receiver 307 receives various control commands transmitted from the remote control device 50, and transmits a control signal based on the command to the control section 310.

The signal separator 308 separates only cognitive signals from signals (broadcast signals and cognitive signals multiplexed) transmitted through the wire 102, and outputs them to the CPU 311 through the external bus 320.

The voltage detector 309 is used to measure the value of a supply voltage to be fed from STB 300 to CTB 200. Specifically, the voltage detector 309 is used to measure at the wire 101 the voltage value of a wire through which a supply voltage is fed.

The control section 310 is composed of the CPU 311, the ROM 312, and the RAM 313. The CPU 311 performs various control operations according to various processing programs stored in the ROM 312. The ROM 312 includes a program storage area to deploy the processing program and the like to be executed by the CPU 311 and a data storage area to store the processing result and the like of each execution of the processing programs.

The ROM 312 stores a system program executable in the STB 300, various processing programs executable by the system program, data to be used in executing these various processing programs, and data resulting from the processing by the CPU 311. The programs are stored in the ROM 312 in the form of computer-readable program codes. Specifically, the ROM 312 contains the transmission program 400, the failure determination program 500, a video signal processing program 600, a channel map 700, and the like.

Figure 3:
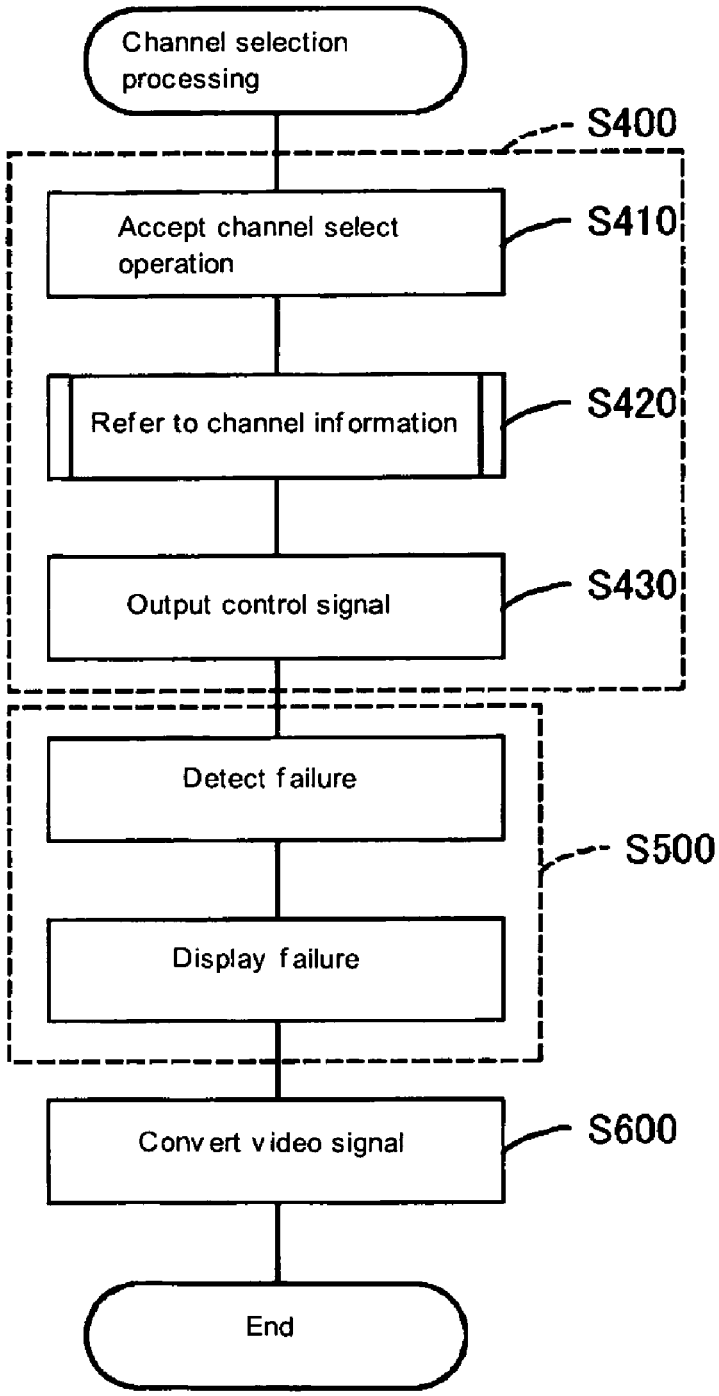
FIG. 3 is a flowchart describing a channel selection process to be performed by a CPU 311.

FIG. 3 is a flowchart describing the channel selection processing to be executed by the CPU 311. When a channel selection operation from a user is accepted, the CPU 311 activates the transmission program 400 to transmit a control signal so as to be able to receive the selected channel optimally (step S400). The CPU 311 then determines whether or not the broadcast signal transmitted from the antenna body 100 are overlapped with a cognitive signal and, based on the result, determines whether or not to display a failure display screen. Finally, the CPU 311 converts received broadcast signals into a form in which the display device 21 can display them. Therefore, functions of the failure determination section and failure reporting section are implemented with the CPU 311 and the failure determination program 500.

The channel map 700 is data to be referred to when selecting a channel and, for example, channel information is stored therein. Specifically, the channel map 700 stores virtual channel numbers allocated to the channel keys and channel up/down keys of the remote control device 50; physical channel numbers; direction information on the direction of antenna directivity; and gain information on antenna gain, all of which are associated with each other. The information to be stored in the channel map 700 is, for example, determined during the initialization of the broadcast signal reception system 10 and stored in the channel map 700.

The transmission program 400 is, for example, a program for implementing a function of causing the CPU 311 to transmit channel information to the CTB 200 through the 909 interface 301. When, for example, a user selects a channel by operating the channel keys, channel up/down keys, or the like of the remote control device 50 (step S410), the CPU 311 refers to the channel information (physical channel number, direction information, gain information, etc.) in the channel map 700 corresponding to the channel number (virtual channel number) of the selected channel (step S420). The CPU 311 then transmits a control signal corresponding to each value of the channel map 700 to the CTB 200 via the 909 interface 301 (step S430).

The failure determination program 500 is a program for implementing a function of causing the CPU 311 to determine whether or not to output a failure display image based on the presence or absence of a cognitive signal from the antenna body 100. If a cognitive signal is not returned from the antenna body 100, the failure determination program 500 causes the CPU 311 to instruct the OSD circuit 306 to overlap the video signal stored in the buffer memory 305 with OSD data that serves as a failure display image. Accordingly, if a cognitive signal is not returned to the STB 300 from the antenna body 100, a failure display image appears on the screen of the display device 21.

Figure 4:
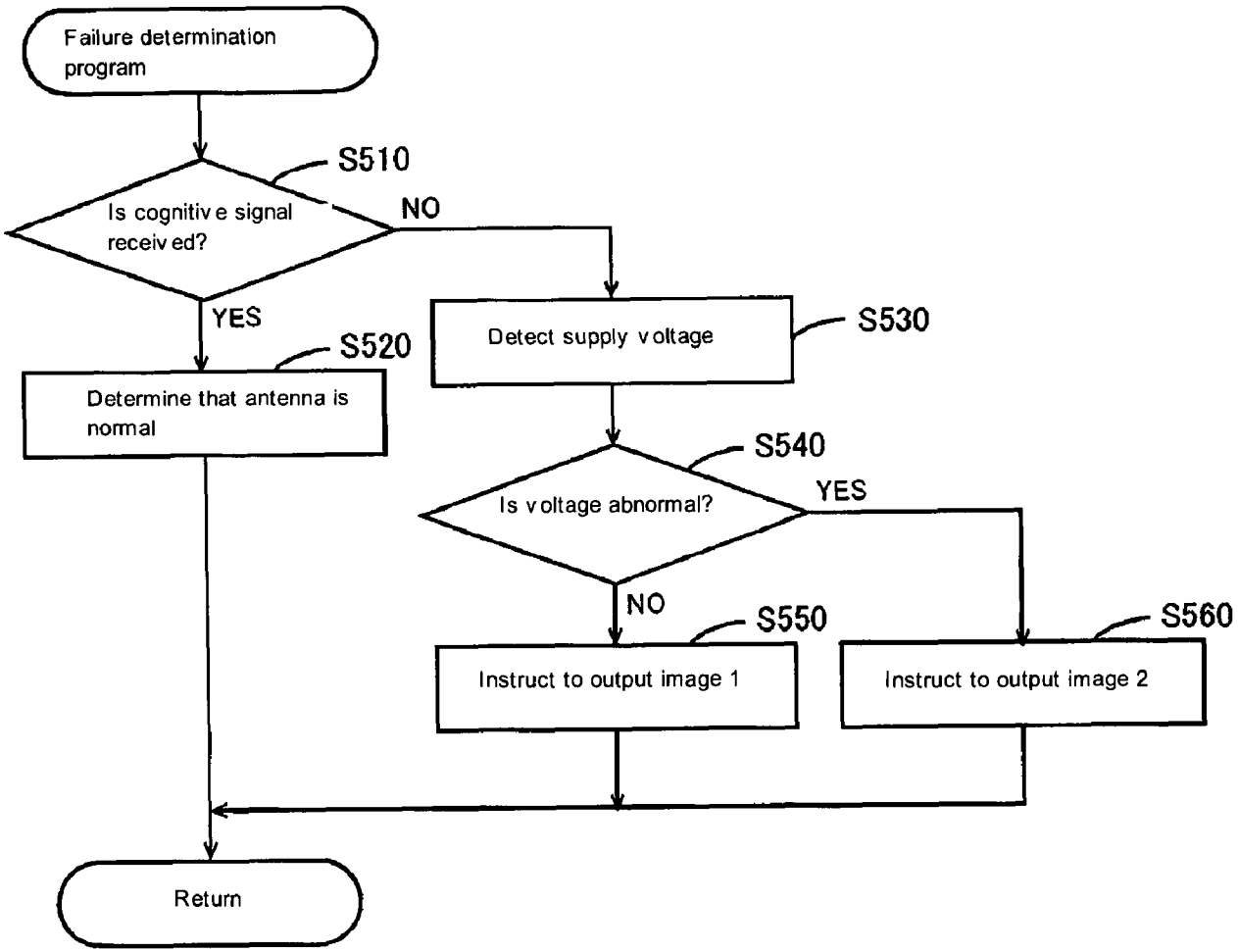
FIG. 4 is a flowchart of the process to be performed by the CPU 311 by means of a failure determination program 500.

FIG. 4 is a flowchart of the processing that the CPU 311 performs by means of the failure determination program 500. First, the CPU 311 causes the signal separator 308 to detect whether or not a cognitive signal is present (step S510). At this time, if the cognitive signal is returned, the CPU 311 determines that the antenna body 100 does not fail (step S520), and terminates the failure determination program 500.

If the cognitive signal is not returned from the antenna body 100, the CPU 311 causes the voltage detector 309 to measure the value of a supply voltage to be fed to the CTB 200 (step S530). If the value of a supply voltage is abnormal (step S540), the CPU 311 instructs the OSD circuit 306 to overlap video signals with OSD data (shown in FIG. 5B) indicating that supply voltage is abnormal (step S560). Conversely, if the value of a supply voltage is normal at step S540, the CPU 311 instructs the OSD circuit 306 to overlap video signals with OSD data (shown in FIG. 5A) indicating that the antenna body 100 fails (step S550). FIG. 5 is a diagram showing an exemplary failure display screen. By the series of operations described above, the CPU 311 detects a failure of the antenna body 100.

The video signal processing program 600 performs a predetermined signal processing for a video signal stored in the buffer memory 305. Specifically, adjustments of the contrast, white balance, sharpness, and the like of the video signal stored in the buffer memory 305 are made. Then, the processed video signal is output to the display device 21 as a picture. By the series of operations described above, a picture corresponding to the selected channel is displayed on the display device 21. Also, when the smart antenna system 30 fails, a failure display screen is displayed.

2.2 Operation and Advantages of the Broadcast Signal Reception System

The operation and advantages of the present invention is described below with reference to FIG. 5.

When a user selects a channel by operating the remote control device 50, a picture corresponding to the selected channel is displayed on the screen of the display device 21. At this time, if the controller 150 of the antenna body 100 fails, the failure display screen of FIG. 5A or FIG. 5B is displayed on the screen. If the failure display screen of FIG. 5A is displayed, the failure of the antenna body 100 is notified to a user. Similarly, if the failure display screen of FIG. 5B is displayed, the failure of the STB 300 is notified to a user. This makes it possible for a user to view these failure display screens and take action appropriate for the failed location displayed. Specifically, if a user notifies the failed location to a service center or the like, the service center can take measures against the failure quickly.

3. Modifications

The present invention allows various modifications.

Although the antenna body 100 and the CTB 200 are shown as independent components in this embodiment, it is possible to contain the CTB 200 within the antenna body 100. Also, the CTB 200 may be contained within the STB 300. Further, the STB 300 may be contained within the display device 21.

The failure reporting section is not limited to one that notifies a failure condition with a picture, and it may be one that notifies a failure by, for example, lighting an indicator lamp disposed on an output device.

4. Conclusion

In a smart antenna system including an antenna body with changeable directivity and a control device to optimize receiving conditions of the antenna body by changing the directivity of the antenna body according to a control signal based on a selected channel, the antenna body having a reception confirming section that, when a control signal is output from the control device, outputs to the control device a cognitive signal indicating the receipt of the control signal, and the control device including a failure determination section that determines that the antenna body fails when the cognitive signal is not received and a failure reporting section that notifies the failure of the antenna body based on the result from the failure determination section.

Preferably, the failure determination section is adapted to detect the value of a supply voltage to be fed to the antenna body when a cognitive signal is not received. As a cause of failure in the smart antenna system, an abnormality of supply voltage to be fed to the antenna body is assumed, in addition to a failure of the antenna body. Therefore, in the invention configured as described above, it is possible to detect the value of supply voltage to be fed to the antenna body and determine which is the cause of the failure.

Preferably, the reception confirming section is adapted to multiplex the cognitive signal with received broadcast signals and output the multiplexed cognitive signal to the control device. In the invention configured as described above, it is possible to transmit the cognitive signal by multiplexing with broadcast signals and thereby to reduce the number of signal wires.

Preferably, the failure reporting section is adapted to display on the screen that the antenna body fails, when the failure determination section did not receive a cognitive signal. In the invention configured as described above, when the failure reporting section detects a failure it displays the failure on the screen and consequently a user can recognize the failure of the smart antenna system visually.

As another aspect of the present invention, the failure detection method for the smart antenna system that optimizes receiving conditions by changing the directivity of the antenna body with a control signal to be output from the control device, includes the steps of: outputting from the antenna body to the control device a cognitive signal indicating the receipt of a control signal when the control signal is output from the control device; and judging that the antenna body fails when the cognitive signal is not received.

As another aspect of the present invention, the antenna body is configured to change the directivity according to the EIA/CEA-909 standard; the reception confirming section multiplexes the cognitive signal with received broadcast signals and outputs the multiplexed cognitive signal to the control device; the failure determination section detects the value of a supply voltage to be fed to the antenna body when the cognitive signal is not received; and the failure reporting section displays on the screen the failure of the antenna body as an OSD image when the failure determination section did not receive the cognitive signal.

While the invention has been particularly shown and described with respect to preferred embodiments thereof, it should be understood by those skilled in the art that the foregoing and other changes in form and detail may be made therein without departing from the spirit and scope of the invention as defined in the appended claims.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A smart antenna system for receiving a broadcasting, comprising:

an antenna body with changeable directivity;

a control device that optimizes receiving conditions of the said antenna body by changing the directivity of the antenna body the control device comprises, a set-top box that connected to the antenna through a wire in order to receive the broadcast signals transmitted from the antenna body, and generates a first control signal for specifying the directivity of the antenna body corresponding to a selected channel, and a control box that outputs a second control signal for adjusting the directivity of the antenna body corresponding to the first control signal to the antenna body, the antenna body comprises a reception confirming section that replies a cognitive signal to the set top box through the wire in order to show that the antenna body received the second control signal, when the antenna body receives the second control signal transmitted from the control box;

the set-top box comprises a failure determination section to determine that the antenna body fails, and a failure reporting section to notify that the antenna body fails based on a result from the failure determination section, the failure determination section measures the value of a supply voltage supplied to the control box when the cognitive signal is not received, and determines the antenna body fails when the measured value of the supply voltage is normal.

2. A smart antenna system according to claim 1, wherein said failure reporting section displays on the screen that said antenna body fails when said failure determination section did not receive said cognitive signal.

* * * * *